US006076501A

United States Patent [19]

Costley et al.

[11] Patent Number: 6,076,501

[45] Date of Patent: Jun. 20, 2000

[54] MIN/MAX SPEED GOVERNOR FOR AN INTERNAL COMBUSTION ENGINE

[75] Inventors: Gregory E. Costley, Lacon; Thomas S. Lane, Metamora; Larry R. Mitzelfelt, Jr., Metamora; Jeffrey R. Ries, Metamora, all of Ill.

[73] Assignee: Caterpillar Inc., Peoria, Ill.

[21] Appl. No.: 09/156,184

[22] Filed: Sep. 17, 1998

[51] Int. Cl.[7] ..... F02D 31/00

[52] U.S. Cl. ..... 123/372; 123/373

[58] Field of Search ..... 123/372, 373, 123/365, 364, 371, 370

[56] References Cited

U.S. PATENT DOCUMENTS

| | | | |
|---|---|---|---|
| 2,818,053 | 12/1957 | Shallenberg | 123/373 |
| 3,082,353 | 3/1963 | Cohen et al. . | |
| 3,766,899 | 10/1973 | Isselhorst | 123/140 |
| 3,795,233 | 3/1974 | Crews | 123/383 |
| 3,911,885 | 10/1975 | Hammond | 123/140 |
| 3,923,026 | 12/1975 | Aoki | 123/140 |
| 3,924,594 | 12/1975 | Aoki | 123/140 |
| 3,977,343 | 8/1976 | Gauche | 123/373 |
| 4,426,970 | 1/1984 | Galis et al. | 123/364 |
| 4,459,956 | 7/1984 | Roca-Nierga et al. | 123/373 |
| 4,502,440 | 3/1985 | Fronk | 123/367 |
| 5,036,815 | 8/1991 | Augustin et al. | 123/358 |
| 5,163,401 | 11/1992 | Reese | 123/376 |
| 5,195,490 | 3/1993 | Maier | 123/373 |
| 5,203,301 | 4/1993 | Maier | 123/373 |
| 5,460,132 | 10/1995 | Ishiwata | 123/372 |

FOREIGN PATENT DOCUMENTS

| | | | |
|---|---|---|---|
| 785992 | 8/1935 | France | 123/372 |

*Primary Examiner*—Carl S. Miller
*Attorney, Agent, or Firm*—Michael McNeil

[57] ABSTRACT

A two speed governor for an internal combustion engine includes a flyweight assembly rotatably mounted in a housing. The riser is positioned in the housing and operably connected to the flyweight assembly. The riser is moveable between a retracted position, and intermediate position and an advanced position. A first spring is operably mounted in the housing to bias the riser toward its retracted position when the riser is located anywhere between its retracted position and its advanced position. A second spring is operably mounted in the housing to bias the riser toward its retracted position when the riser is between its intermediate and advanced positions. The second spring has a pre-load but is inoperable when the riser is between its retracted position and its intermediate position.

20 Claims, 4 Drawing Sheets

63
64
65
56
66
62
57
58
59
60
61
52
54
53
55
68
51
50

MIN/MAX SPEED GOVERNOR FOR AN INTERNAL COMBUSTION ENGINE

TECHNICAL FIELD

The present invention relates generally to speed governors for internal combustion engines, and more particularly to speed governors having the ability to maintain an engine at two or more substantially different predetermined engine speeds.

BACKGROUND ART

In some applications, an engine must have the ability to operate consistently at two distinct speeds with various loads. For instance, engines in farm combines must typically have the ability to operate at two distinctive speeds: a low idle, and a high idle speed. The low idle speed corresponds primarily to a maneuvering speed, whereas the high idle speed corresponds to when the combine is actually in the field harvesting crops. In both instances, it is desirable that the engine operate at a substantially constant speed. This is especially important for the high idle condition where the various machinery that is powered by the engine during a harvesting operation performs best when maintained at a substantially constant predetermined speed. In many combine applications, the high idle rpm can be as much as twice that of the low idle speed. This relatively large speed difference combined with engine compartment space limitations and other factors known in the art, places constraints on the size and structure of an engine speed governor that can perform satisfactorily.

The present invention is directed to these and other problems associated with multiple speed governors for particular engine applications.

DISCLOSURE OF THE INVENTION

An engine speed governor for an internal combustion engine includes a flyweight assembly rotatably mounted in a housing. A riser is positioned in the housing and is operably connected to the flyweight assembly. The riser is moveable between a retracted position and an advanced position, and the riser has an intermediate position between the retracted and the advanced position. A first spring is operably mounted in the housing to bias the riser toward its retracted position when the riser is located between its retracted and advanced positions. A second spring is operably mounted in the housing to bias the riser toward its retracted position when the riser is between its intermediate and advanced positions. The second spring has a pre-load but is inoperable when the riser is between its retracted and intermediate positions.

BEST MODE FOR CARING OUT THE INVENTION

Figure 1:
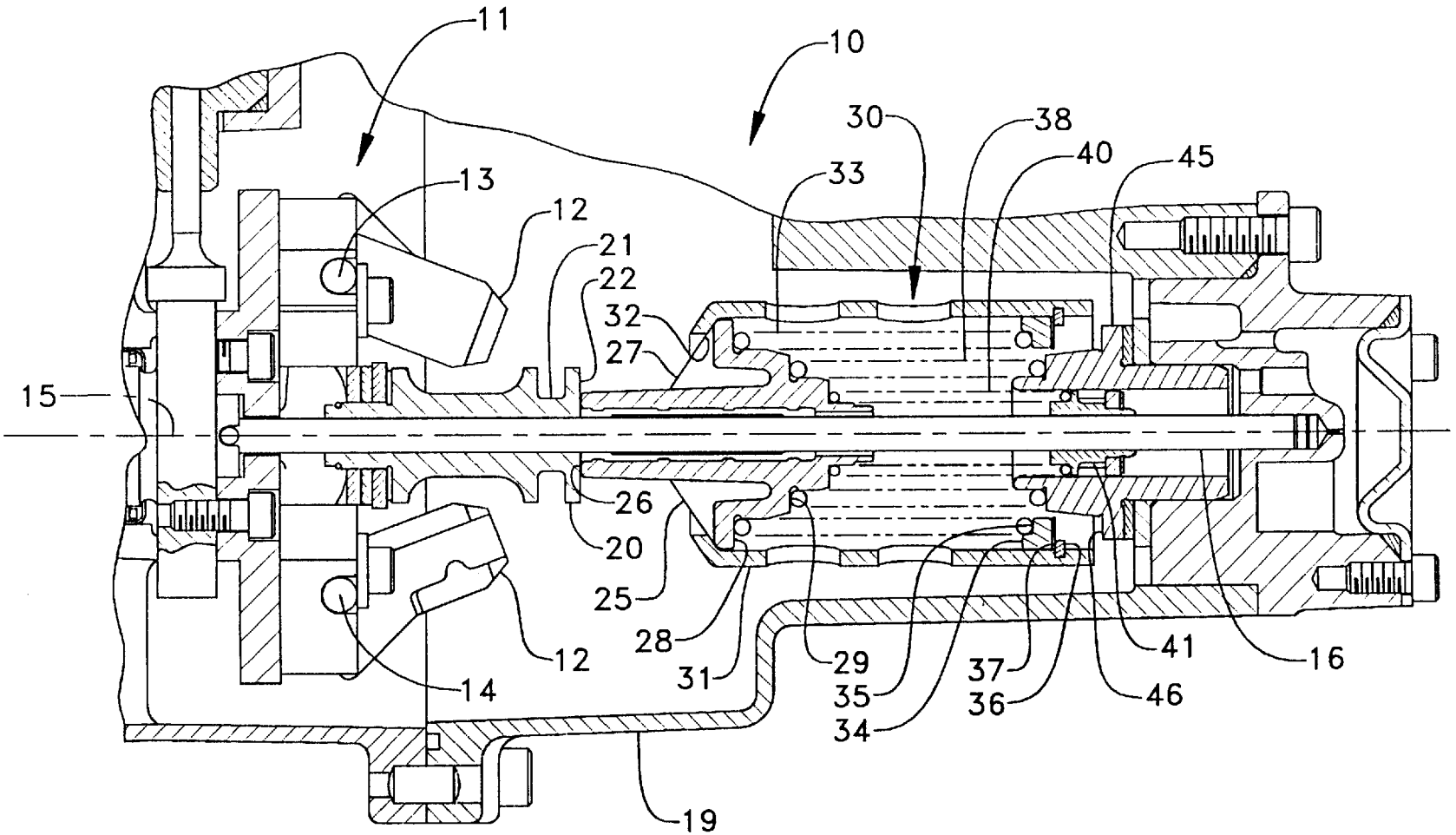
FIG. 1 is a sectioned side diagrammatic view of an engine speed governor according to the present invention.

Referring now to FIG. 1, an engine speed governor 10 includes many known features often encountered in full range governors for diesel type engines manufactured by Caterpillar, Inc. of Peoria, Ill. For instance, governor 10 includes a housing 19 within which a flyweight assembly 11 is rotatably mounted to rotate on a shaft 16 about a center line 15. Flyweight assembly 11 is driven to rotate by the engine in a conventional manner. Flyweight assembly 11 includes a plurality of flyweights 12 that pivot about respective pivot axis 13 and 14 in proportion to the rotational rate of the flyweight assembly. Flyweights 12 are normally biased inward as shown; however, as the rotational rate of flyweight assembly 11 increases, flyweights 12 pivot outward to cause a riser 20 to move toward the right on shaft 16. Thus, riser 20 can be thought of as being operably coupled to flyweight assembly 11 since its lateral position is coupled to the rotation rate of the flyweight assembly.

A riser biasing assembly 30 normally biases riser 20 leftward toward its retracted position, as shown. Riser biasing assembly 30 includes a contact end 26 that bears against a contact end 22 of riser 20. Depending upon the structure of the riser biasing assembly 30 and the flyweight assembly 11, riser 20 can move a predetermined distance toward the right to an advanced position. Those skilled in the art will appreciate that riser 20 includes a coupling annulus 21 whereby movement of riser 20 is transformed into an injector rack movement that determines the amount of fuel injected into the engine. For instance, the farther riser 20 moves toward the right, away from its retracted position, the less fuel is injected into the engine, which tends to cause the engine to operate at a lower speed.

When in operation, governor 10 transfers the requirements of the operator of the engine to the fuel injector rack control linkage. The governor maintains the desired engine speed based upon the position of the throttle (not shown). The governor output shaft moves immediately when the throttle is moved. The movement of the governor output shaft then causes the injector rack control linkage to rotate and move the injector racks. As the rack moves to change the engine speed, the governor adjusts the amount of fuel delivered to the engine cylinders. This causes the engine to stabilize at a speed corresponding to the throttle position. In terms of the internal components of governor 10, the riser 20 will assume an equilibrium position between its retracted position and its advanced position based upon a balance of forces provided by the rotating flyweight assembly 11 and the riser biasing assembly 30. Those skilled in the art will appreciate that a unique riser position exists for every engine speed.

In the preferred application to which the present governor relates, the engine throttle may be positionable by the operator in two distinct positions (low idle and high idle), and may, or may not have the ability to adjust the position of the throttle between the low and high idle positions. In any event, and referring in addition to FIG. 4, when the operator selects a desired speed through the positioning of the throttle, a control lever 58 is moved to a new position. Control lever 58 is operably linked to a governor output shaft 66 via a fulcrum lever 59. Output shaft 66 is operably connected to the injector racks, which are not shown. Fulcrum lever 59 is pinned to a pivot lever 60. This connection provides the operator with direct communication to the governor output shaft 66. As the engine speed changes, fulcrum lever 59 moves to change the governor output shaft 66 to a new stable condition. The same condition occurs when the operator changes the position of control lever 58 by re-positioning the throttle.

Figure 2:
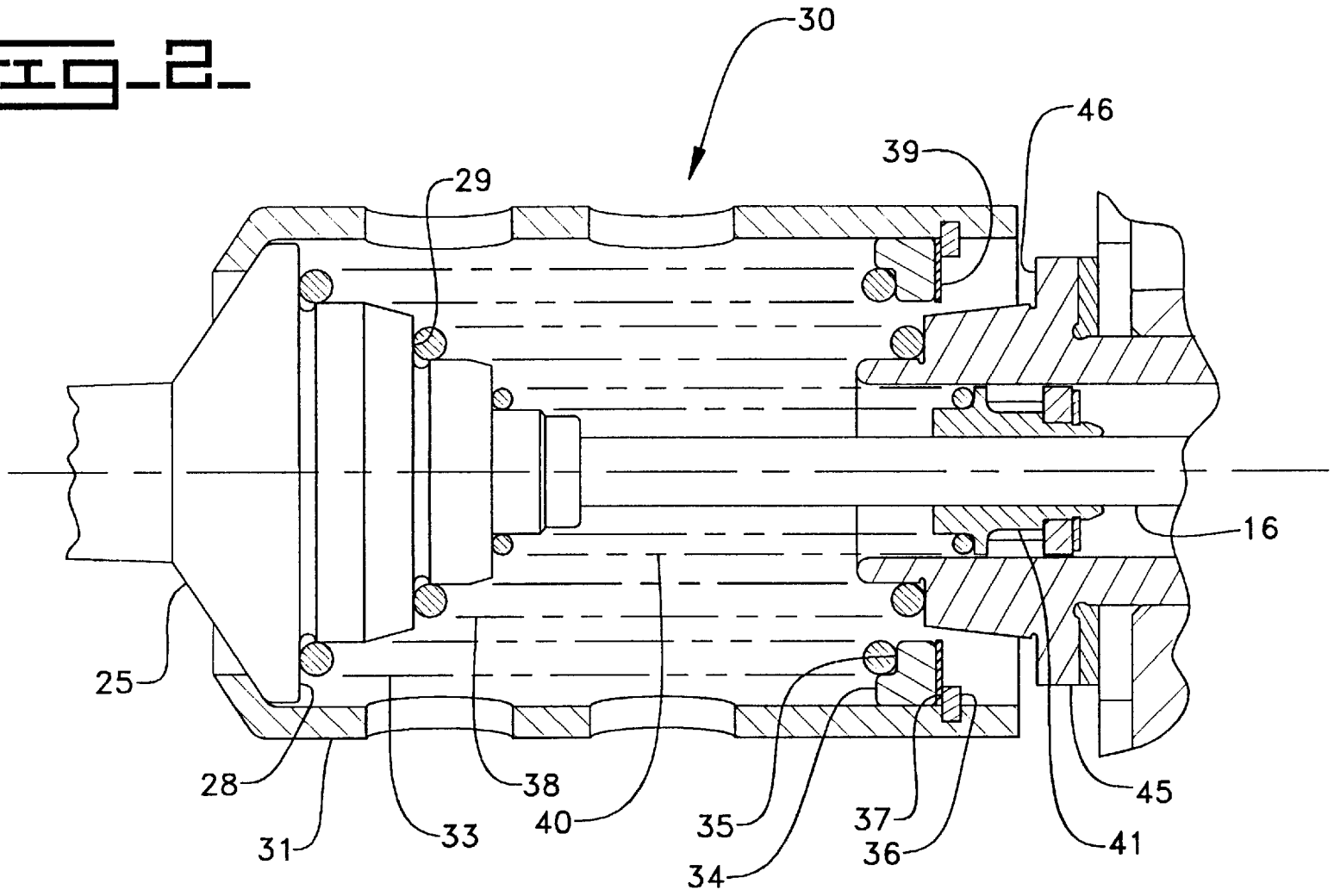
FIG. 2 is a sectioned side diagrammatic view of the spring biasing portion of the governor shown in FIG. 1.

Referring back to FIG. 1 and in addition to FIG. 2, riser biasing assembly 30 includes a plurality of springs positioned between a moveable spring seat 25 and a stationary spring seat 45. In particular, a low idle spring 38 is compressed between stationary spring seat 45 and annular low idle thrust surface 29 of moveable spring seat 25. Low idle spring 38 biases riser 20 toward its leftward retracted position regardless of the position of riser 20. In other words, low idle spring 38 is preferably always compressed. A high idle spring 33 is compressed between a spacer contact surface 35 of spacer 34 and a high idle thrust surface 28 of moveable spring, seat 25. Spacer 34 rests against a high idle shim 39 that bears against a retaining ledge 37 of a retainer ring 36. Retainer ring 36 is mounted inside a spring cage 31 that includes an engagement surface 32 that bears against a conical surface 27 of moveable spring seat 25.

Because high idle spring 33 is compressed between moveable spring seat 25 and retainer ring 36, it has a pre-load but is inoperable to bias riser 20 toward its retracted position until high idle shim 39 engages high idle spring seat 46. When shim 39 contacts high idle spring seat 46, riser 20 can be thought of as being in an intermediate position. Thus, when riser 20 is between its retracted position, as shown, and its intermediate position, only low idle spring 38 is operable to bias riser 20 back toward its retracted position. When riser 20 moves beyond its intermediate position toward its advanced position, high idle shim 39 is lifted from contact with retainer ring 36 and further compresses high idle spring 33. However, in order for this to occur, the force acting on riser 20 from flyweight assembly 11 must overcome the pre-load in high idle spring 33. Thus, when riser 20 is between its intermediate and advanced positions, both low idle spring 30 and high idle spring 33 are operable to bias riser 20 back toward its retracted position.

In part to make the governor more responsive at the high idle condition, high idle spring 33 preferably has a higher spring rate than low idle spring 38. In order to make the riser biasing assembly 30 as compact as possible, the springs are preferably nested within one another to share a common centerline 15 as shown. At least in part to produce an engine speed dead band of the size shown in FIG. 3, the pre-load on high idle spring 33 is preferably greater than the load on low idle spring 38 when riser 20 is positioned in its intermediate position described earlier. In order to damp oscillations in governor 10, due to movement of riser 20, a dashpot spring 40 and dashpot 41 are movably mounted on shaft 16.

Figure 4:
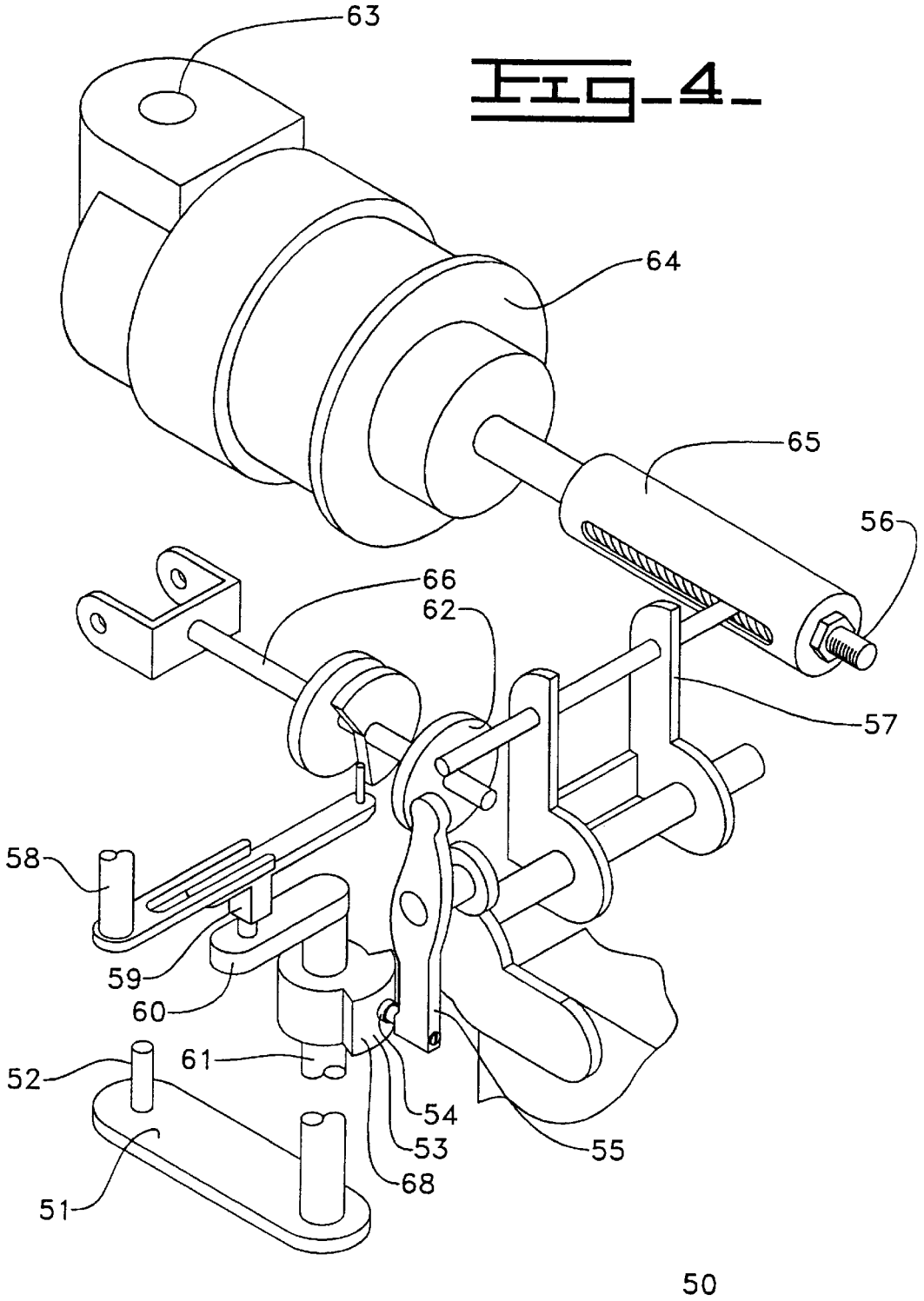
FIG. 4 is an isometric diagrammatic view of a torque control assembly according to one aspect of the present invention.

In order to prevent the attached engine (not shown) from becoming over torqued and in order to provide additional torque, if available when the engine is heavily loaded, the speed governor of the present invention preferably includes a torque control assembly 50 of the type illustrated in FIG. 4. Torque control assembly 50 acts to limit the fuel injected into the engine when rated load or a lug condition is reached. When this condition occurs, a limit flange 62 and governor output shaft 66 contact a torque lever cam 55. The torque cam lever and a torque cam screw 54 then pivot and contact a torque cam 53 having a particular profiled cam surface 68. This corresponds to the maximum fuel on position. Unlike many other types of governors, there is no pivoting limit lever. Like many other types of governors, if more load is applied to the engine in this condition, engine speed will decrease. This decrease will be felt by the flyweights 12 (FIG. 1), causing the riser 20 to rotate a riser lever 51 due to the positioning of pin 52 in coupling annulus 21 (FIG. 1). This movement will cause riser lever 51 and a pivot shaft 61 to move to a new position. Since torque cam 53 is fixed to pivot shaft 11, different torque characteristics can be achieved by changing the profile cam surface 68 on torque cam 53. Torque control assembly 50 allows governor 10 to have both positive and negative torque control. This prevents over torqueing of the engine and permits additional torque, if available, at heavily loaded conditions.

A fuel ratio control 64 limits the fuel by preventing the limit flange 62 from traveling toward cam lever 55. This is accomplished with the fuel ratio control lever 57. As boost pressure increases, control lever 57 rotates further, which then allows the governor output shaft 66 to move to a more fuel on position. At full boost, limit flange 62 will not be restricted by the fuel ratio control 64. The fuel ratio control operates on boost air pressure delivered by a tube between an inlet port and 63 and the inlet manifold of the engine (not shown). At low boost pressure, a retainer shaft 65 is held stationary by springs positioned within fuel ratio control 64. When the operator demands more fuel, the internal governor linkage moves in the fuel on direction until control lever 57 contacts a retainer, at which point additional fueling is prevented. As engine power increases, boost pressure also increases. This pressure acts against a diaphragm. When boost pressure is sufficient, a spring force is overcome and retainer shaft 65 moves to the right. This permits control lever 57 to move, allowing the internal governor linkage to move further in the fuel on direction.

Industrial Applicability

Figure 3:
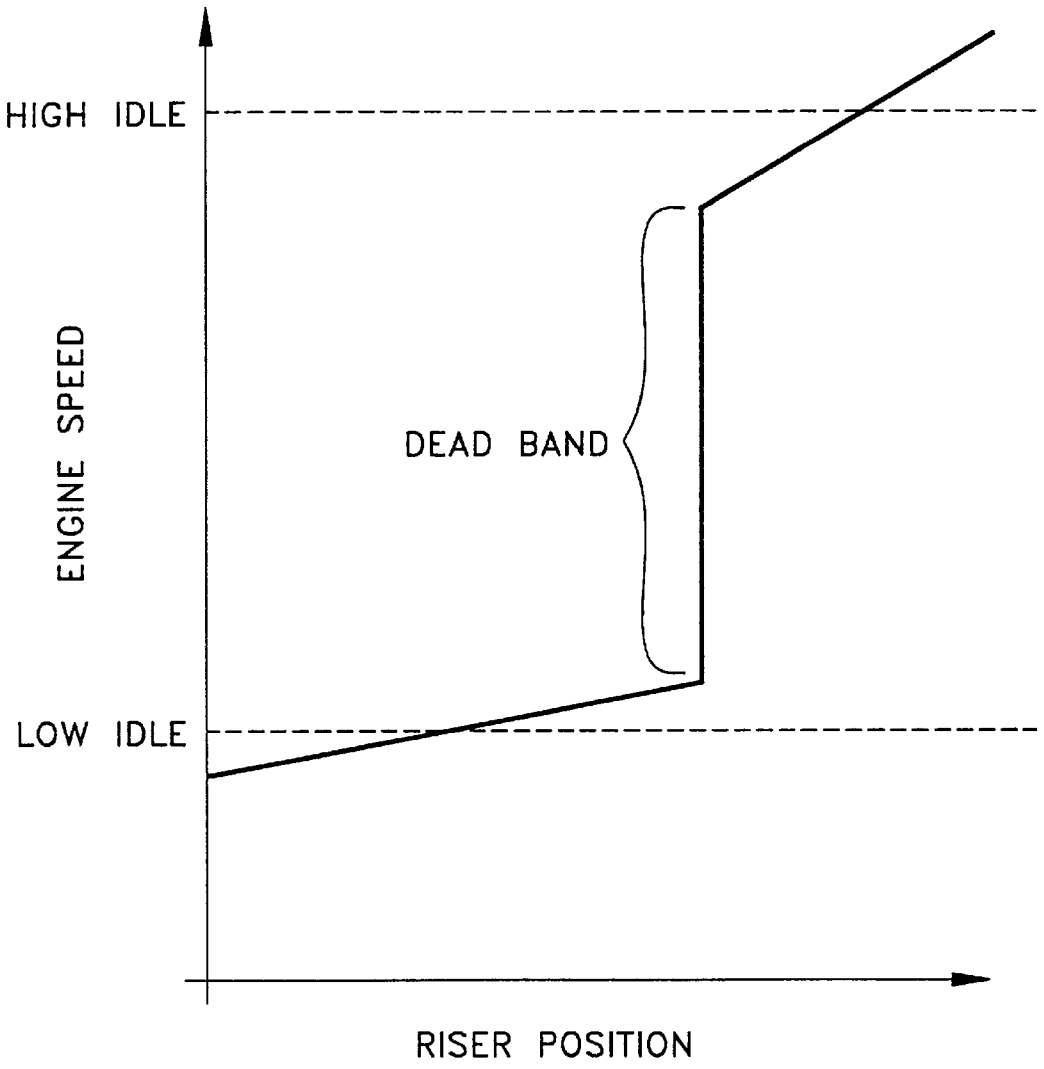
FIG. 3 is a graph of engine speed versus riser position for an engine speed governor according to one aspect of the present invention.

Referring now in addition to FIG. 3, when the operator positions the throttle in its low idle position, the riser 20 is positioned at a location between its retracted position, as shown, and its intermediate position described earlier. Depending primarily upon the spring rate of low idle spring 38, and the variation in load applied to the engine, the engine will oscillate within some predetermined range about the low idle speed. When the operator desires to change the throttle to the high idle position, such as to perform harvesting operations in the case of a combine application, the riser moves to a position between its intermediate position and its advanced position. At this location, both high idle spring 33 and low idle spring 38 are biasing riser 20 leftward toward its retracted position. This force will become balanced with the rotation rate of flyweight assembly 11. The combined springs tend to cause the engine speed to oscillate in a relatively tight range about the high idle speed, even when load on the engine varies significantly.

The above description is intended for illustrative purposes only, and is not intended to limit the scope of the invention in any way. For instance, while the present invention has been described in the context of an engine speed governor for a combine having two distinct desired speed settings, the present invention could also be modified to include three or more distinct speed settings that are separated by different speed dead bands. In such a case, three or more springs would be included and have different pre-loads and would be oriented to become operable at different riser positions. In addition, while the springs of the present invention have been shown nested within one another, other orientations could be employed. Thus, various modifications could be made to the disclosed embodiment without departing from the intended spirit and scope of the present invention, which is defined in terms of the claims set forth below.

What is claimed is:

1. An internal combustion engine speed governor comprising a housing;

a flyweight assembly rotatably mounted in said housing;

a riser positioned in said housing and being operably connected to said flyweight assembly, and being movable between a retracted position and an advanced position, and said riser having an intermediate position between said retracted position and said advanced position;

said retracted position corresponding to said flyweight assembly being in an inward configuration, and said advanced position corresponding to said flyweight assembly being in an outward configuration;

a first spring operably mounted in said housing to bias said riser toward said retracted position when said riser is located between said retracted position and said advanced position; and a second spring operably mounted in said housing to bias said riser toward said retracted position when said riser is between said intermediate position and said advanced position, and said second spring having a preload but inoperable when said riser is between said retracted position and said intermediate position.

2. The governor of claim 1 wherein said first spring has a first spring rate;

said second spring has a second spring rate; and said second spring rate is larger than said first spring rate.

3. The governor of claim 1 wherein said first spring is at least partially surrounded by said second spring.

4. The governor of claim 3 wherein said first spring is concentrically positioned with respect to said second spring.

5. The governor of claim 1 wherein said first spring has a load when said riser is in said intermediate position; and said load is less than said preload of said second spring.

6. The governor of claim 1 wherein said advanced position of said riser is defined by an orientation of a torque control assembly having a torque cam; and said orientation being operably coupled to movement of said riser.

7. The governor of claim 1 wherein said second spring is at least partially positioned within a spring cage;

said preload of said second spring bears against said spring cage when said riser is between said retracted position and said intermediate position.

8. The governor of claim 7 wherein said second spring is decoupled from said spring cage when said riser is between said intermediate position and said advanced position.

9. An internal combustion engine speed governor comprising:

a housing;

a flyweight assembly rotatably mounted in said housing;

a riser positioned in said housing and being operably connected to said flyweight assembly, and being movable between a retracted position and an advanced position, and said riser having an intermediate position between said retracted position and said advanced position;

said retracted position corresponding to said flyweight assembly being in an inward configuration, and said advanced position corresponding to said flyweight assembly being in an outward configuration a first spring operably mounted in said housing to bias said riser toward said retracted position when said riser is located between said retracted position and said advanced position;

a second spring operably mounted in said housing to bias said riser toward said retracted position when said riser is between said intermediate position and said advanced position, and said second spring having a preload but inoperable when said riser is between said retracted position and said intermediate position; and said first spring being concentric with, and at least partially surrounded by, said second spring.

10. The governor of claim 9 wherein said first spring has a first spring rate;

said second spring has a second spring rate; and said second spring rate is larger than said first spring rate.

11. The governor of claim 10 wherein said first spring has a load when said riser is in said intermediate position; and said load is less than said preload of said second spring.

12. The governor of claim 11 wherein said second spring is at least partially positioned within a spring cage;

said preload of said second spring bears against said spring cage when said riser is between said retracted position and said intermediate position.

13. The governor of claim 12 wherein said second spring is decoupled from said spring cage when said riser is between said intermediate position and said advanced position.

14. The governor of claim 13 wherein said advanced position of said riser is defined by an orientation of a torque control assembly having a torque cam; and said orientation being operably coupled to movement of said riser.

15. An internal combustion engine speed governor comprising:

a housing;

a flyweight assembly rotatably mounted in said housing;

a riser positioned in said housing and being operably connected to said flyweight assembly, and being movable between a retracted position and an advanced position, and said riser having an intermediate position between said retracted position and said advanced position;

said retracted position corresponding to said flyweight assembly being in an inward configuration, and said advanced position corresponding to said flyweight assembly being in an outward configuration a first spring with a first spring rate operably mounted in said housing to bias said riser toward said retracted position when said riser is located between said retracted position and said advanced position;

a second spring with a second spring rate operably mounted in said housing to bias said riser toward said retracted position when said riser is between said intermediate position and said advanced position, and said second spring having a preload but inoperable when said riser is between said retracted position and said intermediate position; and said second spring rate being larger than said first spring rate.

16. The governor of claim 15 wherein said advanced position of said riser is defined by an orientation of a torque control assembly having a torque cam; and said orientation being operably coupled to movement of said riser.

17. The governor of claim 16 wherein said first spring is concentric with, and at least partially surrounded by, said second spring.

18. The governor of claim 17 wherein said second spring is at least partially positioned within a spring cage;

said preload of said second spring bears against said spring cage when said riser is between said retracted position and said intermediate position.

19. The governor of claim 18 wherein said second spring is decoupled from said spring cage when said riser is between said intermediate position and said advanced position.

20. The governor of claim 19 wherein said spring cage defines a retaining ledge; and a spacer positioned between said second spring and said retaining ledge.

* * * * *